United States Patent [19]

Paula

[11] Patent Number: 4,535,479

[45] Date of Patent: Aug. 20, 1985

[54] TWO PERSON GARMENT

[76] Inventor: M. Fatima M. Paula, P.O. Box 224, Dorchester, Mass. 02122

[21] Appl. No.: 665,613

[22] Filed: Oct. 29, 1984

[51] Int. Cl.[3] ..... A41B 1/12

[52] U.S. Cl. ..... 2/69.5; 2/115

[58] Field of Search ..... 2/69, 69.5, 115, 108

[56] References Cited

U.S. PATENT DOCUMENTS 12,170 11/1902 Crimins ..... 2/69.5

3,523,302 8/1970 Rabedeaux ..... 2/69.5

*Primary Examiner*—Doris L. Troutman

*Attorney, Agent, or Firm*—Robert B. Block; Lewis Anten

[57] ABSTRACT

A garment for two persons to wear together such as a T-shirt, sweatshirt, beach cover, or jacket having a body part for surrounding both persons in a single wrap, closed at its top and sides and provided with two neck openings side by side spaced a body-width apart to allow room for two and having one arm hole at each side for one of the arms of each of the persons. It is uniquely designed to bring people together in a cozy arrangement, be it lovers, twins or friends, and can range in size from infants to adults.

5 Claims, 7 Drawing Figures

TWO PERSON GARMENT

SUMMARY OF THE INVENTION

The present invention relates to garments and particularly to articles of outdoor clothing in the nature of a T-shirt, sweatshirt, beach cover, bathrobe, sweater or jacket-type made large enough to be worn by and envelop two people at the same time. It is designed for its uniqueness in sharing and caring, and for being worn by lovers, twins, and friends.

There are may occasions when two people want to be very close to each other, i.e. in bodily contact, while being in public. Such occasions include sporting and outdoor music events, evenings at the campfire or beach, or for just plain fun. Adequate clothing for such purposes has not been available.

In general, it is an object of the present invention to provide a new garment for two people to wear together in public.

A further object of the invention is to provide a garment of the above character which can be implemented in numerous forms of clothings such as T-shirts, sweatshirts, robes, jackets, infants wear and just about any article of outer clothing.

The present invention provides a garment having a body large enough to encompass two persons around and closed at its lateral extent to completely surround the persons and also closed at its upper portion. The garment is provided with two neck openings spaced about a body width apart and further provided with two arm openings for sleeves on opposite sides, one of which is for the left arm of one person, and the other opening for the right arm of the other person. The body can be continuous as in a pull-over or openable for each person as by having a zipper openable fronts. The neck treatment may be plain, collared, or hooded and the arm openings sleeveless or sleeved.

These and other objects and features of the invention will become apparent from the accompanying detailed description, claims, and drawings, of which:

DETAILED DESCRIPTION OF THE PREFERRED EMBODIMENTS

Figure 1:
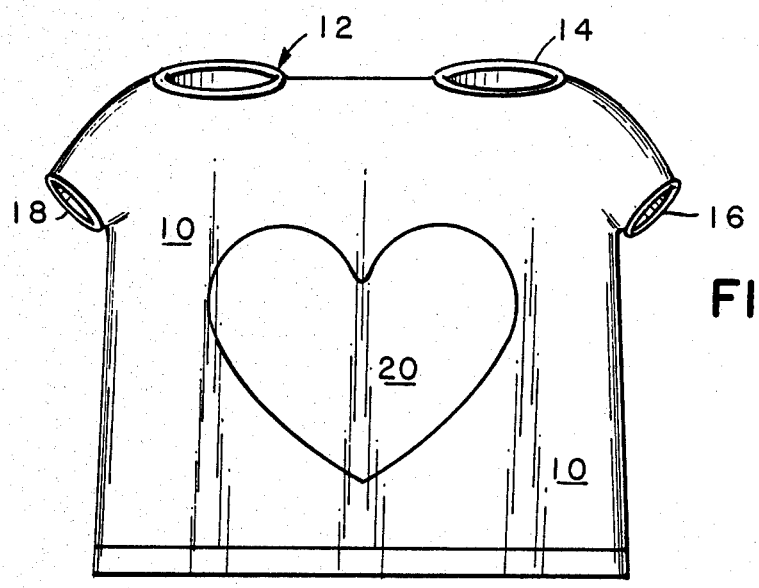
FIG. 1 is a front view of a T-shirt constructed in accordance with present invention.

Each of the garments of the present invention consists of a body 10 of fabric large enough to surround two persons in one wrap. The body is closed at the top and sides. The top is provided with a pair of neck openings 12, 14 spaced about a body-width apart, and one each left and right arm opening or sleeve 16, 18 is provided at the left most and right most upper extremes of the body 10. When worn, the right and left persons are side-by-side with their respective heads passed through the neck openings and the right person's right arm extending through the right arm opening 16 and the left person's left arm extending through the left arm opening 18 Their other arms are concealed within the garment.

Figure 2:
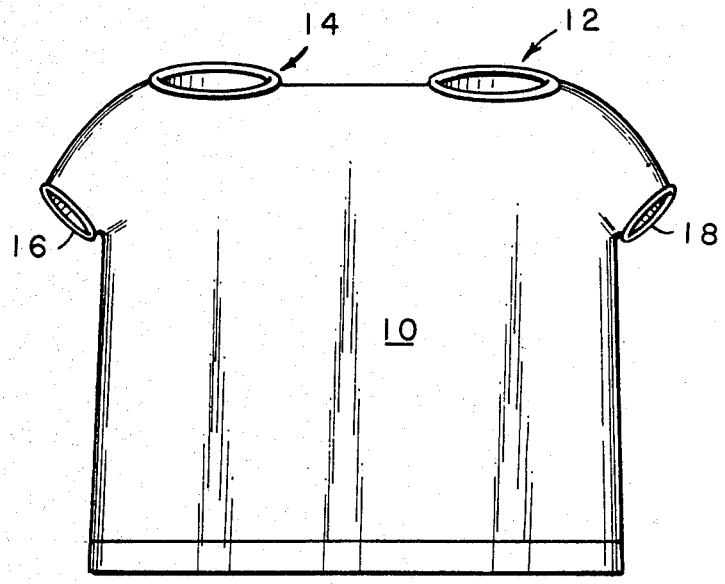
FIG. 2 is a back view of the T-shirt of FIG. 1.

Referring particularly to FIGS. 1 and 2 a T-shirt is shown which is made in accordance with the present invention and includes short sleeves and standard neck openings, all of which may be reinforced with cotton ribbing material. A heart shaped pocket 20 is sewn onto the front of the T-shirt to amplify the intent of the wearers.

Figure 3:
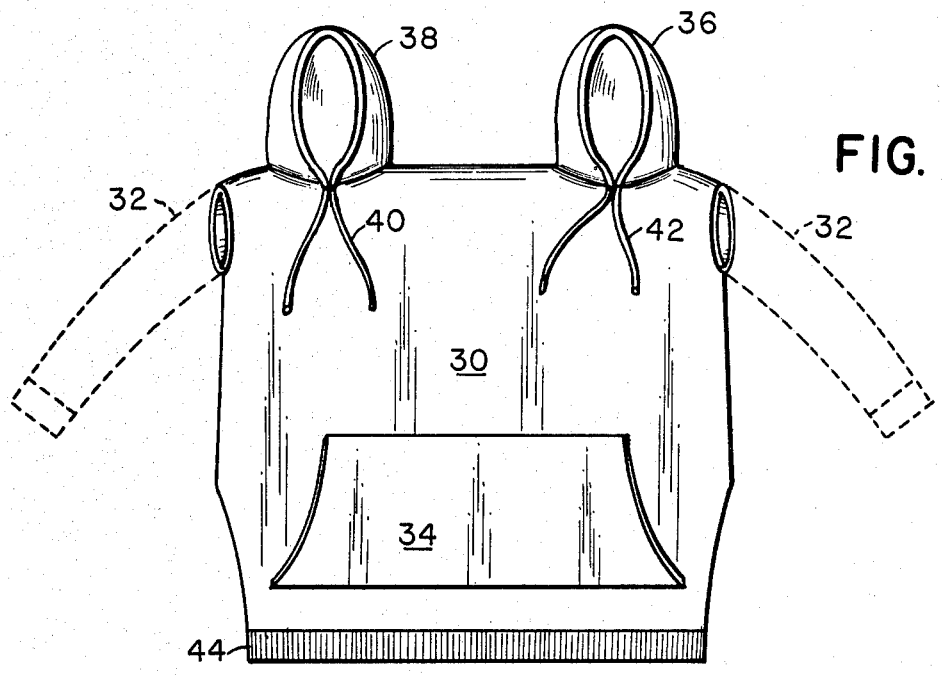
FIG. 3 is a front view of a hooded vest constructed in accordance with the present invention.
Figure 4:
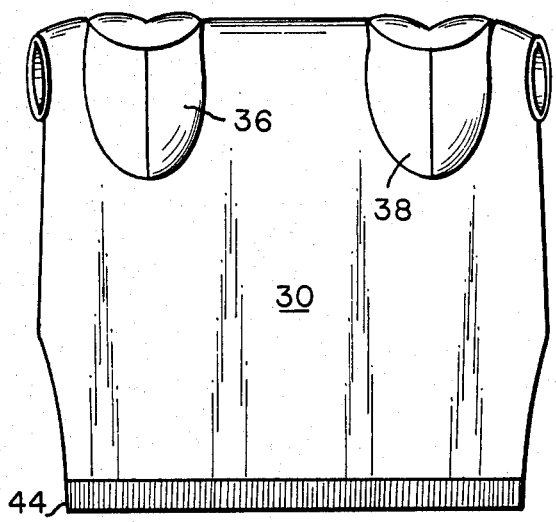
FIG. 4 is a back view of the hooded vest of FIG. 3.

FIGS. 3 and 4 illustrate a hooded vest which having a body 30 and may be sleeveless as shown or provided with sleeves 32 (shown in dotted lines). The vest is provided with a center pocket 34 sewn at its upper and lower extremes and open at its sides for carrying objects or for placing the hands. The pocket is an open throughway so that the wearers may hold hands. Each of the neck openings is fitted with a hood 36, 38 which surrounds the neck opening at the base and is provided with a facial opening closable with a drawstring 40, 42. An elastic waistband 44 is attached at the lower end.

Figure 5:
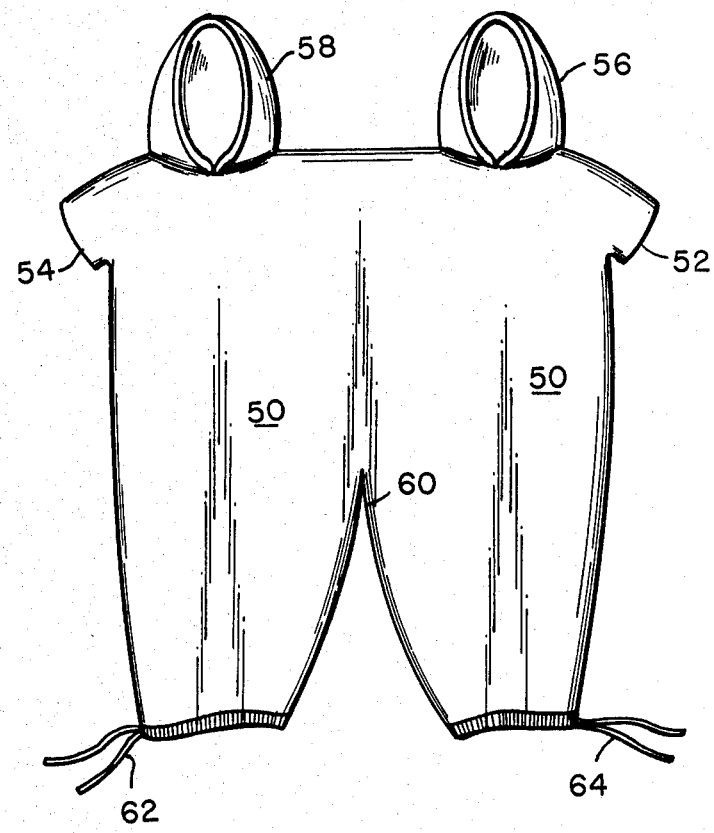
FIG. 5 is a front view of an infants outer bunting constructed in accordance with the present invention.

FIG. 5 illustrates an infants bunting for twins for example and includes a body 50 provided with short sleeves 52, 54 and hoods 56, 58 similar to that as shown in FIGS. 3 and 4. The lower end of the bunting is partially separated at 60 so that the infants do not kick each other and each lower extremes are closable is a relatively conventional way for infants wear with simple drawstrings 62, 64 opening to form a sack.

Figure 6:
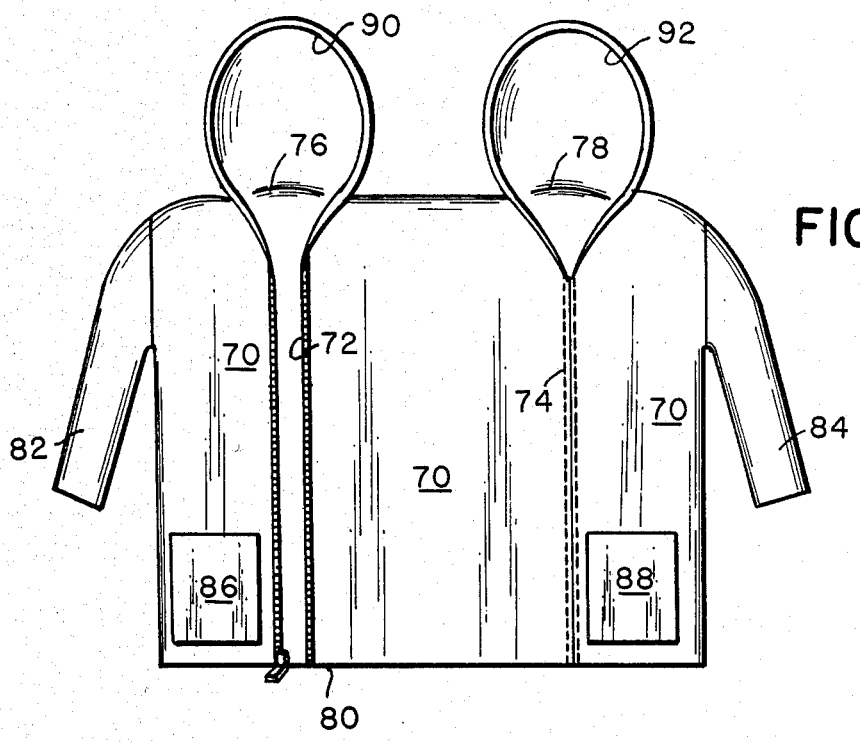
FIG. 6 is a front view of jacket constructed in accordance with the present invention.
Figure 7:
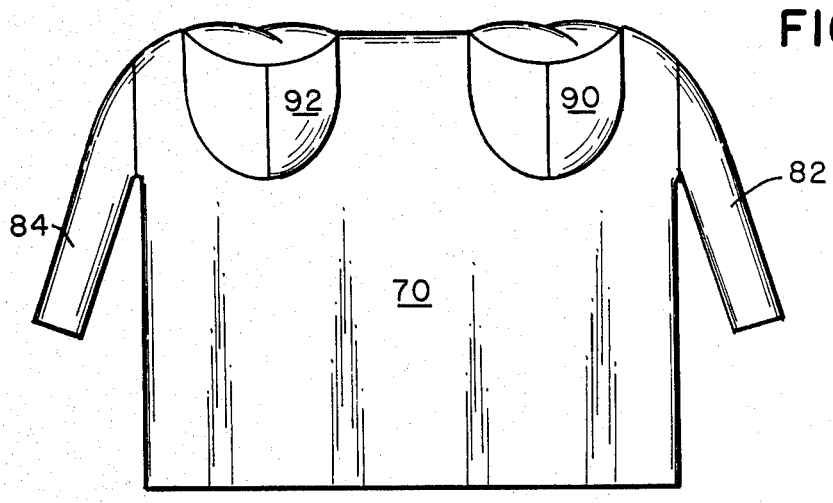
FIG. 7 is a back view jacket of FIG. 6.

FIGS. 6 and 7 show a jacket constructed in accordance with the present invention with a body 70 having two full zippered front openings 72, 74 extending from the necks 76, 78 to the base 80 and full sleeves 82, 84. The jackets are also provided with flap pockets 86, 88 for the convenience of carrying small objects and are hooded at 90, 92.

The construction of the garments of the present invention is relatively straightforward with conventional seams for the sleeve openings and sleeve attachment and side seams. The edges of the fabric are zigzagged to close and the hems and sleeve edges formed in the usual manner. The zippers may be stitched in the usual way of following manufacturers directions. In place of zippers a row of snaps set on bands may be used.

The clothing can be made of any desired fabric but in the preferred embodiments of the invention, the shirts are made of a woven cotton, 50/50 polyester-cotton blend, fleece, terry cloth and velour materials such as is ordinarily used for t-shirts, sweatshirts, bathrobes and beach covers. Stretch fabrics are very useful in this application so that the persons can move about.

Shirts are made of all colors ranging from white through black, plain or printed, solid or with contrast, sleeve or sleeveless, with sewn on or detachable hood or none.

What is claimed is:

1. A single garment for covering the upper bodies of two persons comprising a fabric body covering said two persons in a single wrap in the manner of a T-shirt, sweatshirt, beach cover, robe or jacket, means forming two neck openings spaced far enough from each other to fit two persons comfortably, means forming one left arm opening, and means forming one right arm opening respectively at each side of the body.

2. A single garment for covering the upper bodies of two persons comprising a body forming a single wrap closed at its top and sides and open at the bottom, means forming neck openings at the top spaced apart about a body-width from each other, means forming one left arm opening at the left side of the garment, and means forming

3. A garment as in claim 2 further including means forming hoods attached to each of the neck openings.

4. The garment as in claim 2 further including means forming front openings for each side of the garment and descending from the respective neck opening thereat, fastening means for closing each of said front openings.

5. A garment as in claim 2 further including a large pocket formed in the front of the garment and covering the space between the persons, said pocket having a lateral passage therein from one side to the other and open at each side.

* * * * *